US011471896B2

(12) United States Patent
Lagace

(10) Patent No.: US 11,471,896 B2
(45) Date of Patent: Oct. 18, 2022

(54) FEED BOX FOR DECANTER CENTRIFUGE

(71) Applicant: 2460257 Ontario Inc., London (CA)

(72) Inventor: Denis Robert Lagace, London (CA)

(73) Assignee: 2460257 ONTARIO INC., London (CA)

( * ) Notice: Subject to any disclaimer, the term of this patent is extended or adjusted under 35 U.S.C. 154(b) by 356 days.

(21) Appl. No.: 16/735,064

(22) Filed: Jan. 6, 2020

(65) Prior Publication Data

US 2020/0215552 A1 Jul. 9, 2020

Related U.S. Application Data

(60) Provisional application No. 62/789,691, filed on Jan. 8, 2019.

(51) Int. Cl.

| | |
|---|---|
| ***B04B 11/06*** | (2006.01) |
| ***B04B 11/02*** | (2006.01) |
| ***B04B 1/20*** | (2006.01) |
| ***B04B 3/04*** | (2006.01) |

(52) U.S. Cl.

CPC ..... *B04B 1/20* (2013.01); *B04B 3/04* (2013.01); *B04B 11/02* (2013.01); *B04B 11/06* (2013.01); *B04B 2001/205* (2013.01); *B04B 2001/2033* (2013.01); *B04B 2001/2083* (2013.01); *B04B 2001/2091* (2013.01)

(58) Field of Classification Search

CPC .. B04B 1/20; B04B 3/04; B04B 11/02; B04B 11/06; B04B 2001/2033; B04B 2001/205; B04B 2001/2083; B04B 2001/2091

USPC ..... 494/53

See application file for complete search history.

(56) References Cited

U.S. PATENT DOCUMENTS

| | | | | |
|---|---|---|---|---|
| 2,924,178 A * | 2/1960 | Hogan | F04C 14/223 418/31 |
| 3,228,593 A * | 1/1966 | Topping | B04B 1/2008 494/53 |
| 3,428,246 A * | 2/1969 | Finkelston | B04B 1/20 210/377 |
| 2014/0005024 A1* | 1/2014 | Reiff | B04B 1/20 494/53 |

FOREIGN PATENT DOCUMENTS

| | | |
|---|---|---|
| CA | 2932188 A1 | 12/2017 |
| EP | 3106230 A1 | 12/2016 |

* cited by examiner

*Primary Examiner* — Shuyi S. Liu

(57) ABSTRACT

A feed box for a decanter centrifuge has a housing with a hollow interior, the housing having a top with an inlet therethrough, a bottom, sides, and opposing open ends, wherein the inlet and the open ends are in fluid communication with the hollow interior. A liner shaped complementary to the hollow interior of the housing, has a top, a bottom, sides, opposing ends, an opening through the top of the liner below the inlet, and a channel through the liner between the opposing ends in fluid communication with the inlet.

10 Claims, 5 Drawing Sheets

FEED BOX FOR DECANTER CENTRIFUGE

FIELD OF THE INVENTION

The present invention relates to decanter centrifuges, in particular, to feed boxes for decanter centrifuges.

BACKGROUND

Decanter centrifuges separate solids and liquids from a slurry based on the relative densities of the materials. The centrifuges continuously rotate to produce high g-forces that accelerate the rate of separation of the materials. They are used in a number of industrial processes, including food processing, chemical production, and resource extraction.

A typical decanter centrifuge has a cylindrical or conical decanter bowl, which rotates at high speed. Inside the decanter bowl is a scroll, which rotates at a slightly different speed to collect and remove the dense material that separates and accumulates on the inside of the decanter bowl. A feed box rotates with the decanter scroll and receives the incoming slurry, or feed, from an inlet, or feed pipe. The feed box accelerates the feed as it moves from the feed pipe outwardly into the decanter bowl.

In certain applications, such as the use of decanter centrifuges in resource extraction to dewater oil sands tailings, the incoming suspension of solid particles and liquid, or "feed", is highly abrasive and causes wear on the components of the centrifuge. This can cause certain parts to fail, requiring downtime for maintenance and/or replacement. In particular, the feed box is subject to extreme wear as the feed accelerates from the feed pipe to the decanter bowl. This can cause the feed box walls to wear through and form holes in the feed box, a process known as "washout".

Attempts to provide replaceable wear liners in the feed box, that may be quickly and easily replaced to minimize downtime for maintenance have included providing tubular inserts at the outlets of the feed box, for example, as provided by the Alpha Laval™ Lynx 40™ system. These inserts are simple to remove and replace, however, they do not protect the walls of the feed box between the outlet ends, which are still subject to wear and susceptible to washout.

Other attempts to address the problem of wear in the feed box have provided a plurality of inserts that may be assembled within the feed box to protect substantially the entire interior of the feed box, for example, as disclosed in US 2014/0005024 A1. However, the installation of the plurality of inserts requires manipulation of the inserts within the interior of the feed box through the outlets. This requires manual dexterity to separate and remove the worn-out inserts in the feed box and to install and fit-together the replacement inserts. Additional maintenance downtime is required to ensure a proper fit and installation of the plurality of inserts in the feed box.

Accordingly, there is a need for a feed box with a wear-protection element that is fast and simple to remove and replace and also protects substantially the entire interior of the feed box from wear caused by the abrasive feed flow.

SUMMARY OF THE INVENTION

A feed box for a decanter centrifuge, according to the present invention, has a housing with a hollow interior, the housing having a top with an inlet therethrough, a bottom, sides, and opposing open ends, wherein the inlet and the open ends are in fluid communication with the hollow interior. A liner shaped complementary to the hollow interior of the housing, has a top, a bottom, sides, opposing ends, an opening through the top of the liner below the inlet, and a channel through the liner between the opposing ends in fluid communication with the inlet.

In another embodiment, the liner is a single-piece structure.

In another embodiment, a diverter is positioned below the inlet within the channel.

In another embodiment, an accelerator is positioned below the inlet within the channel.

In another embodiment, the liner is secured in the hollow interior of the housing by one or more keys, which engage the liner and the housing to limit relative movement therebetween.

In another embodiment, the one or more keys slide into one or more first grooves on the inside of the housing which line up with one or more second grooves on the outside of the liner.

BRIEF DESCRIPTION OF THE DRAWINGS

In order that the invention may be more clearly understood, a preferred embodiment thereof will now be described in detail by way of example, with reference to the accompanying drawings, in which.

DESCRIPTION OF THE INVENTION

A feed box for a decanter centrifuge, according to the present invention, has a housing configured to receive and lock a one-piece liner therein. The liner covers substantially all of the interior surfaces of the housing to protect the housing from wear. The feed box facilitates quick and easy replacement of worn liners to minimize maintenance downtime of the decanter centrifuge.

The feed box 1 is rotatably mounted within the decanter centrifuge and receives a continuous flow of solid particles suspended in a liquid, referred to as "feed", through an inlet 2 on the top of the feed box 1. The feed flows into the feed box 1 through the inlet 2 and is accelerated as it flows out of the feed box 1 through two opposing outlets 3 on the opposing ends of the feed box 1.

Figure 8:
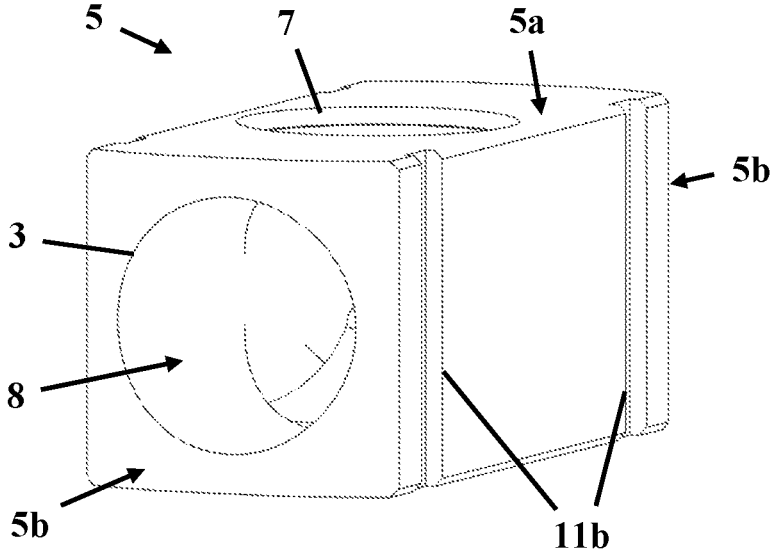
FIG. 8 is a perspective view of the liner of the feed box.
Figure 10:
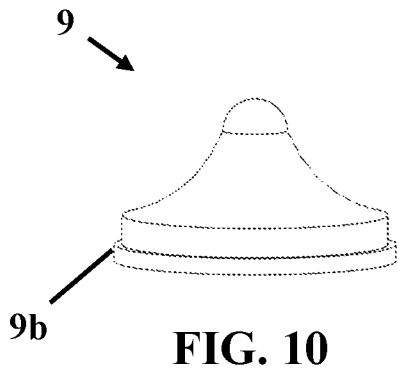
FIG. 10 is a perspective view of the diverter of the feed box.
Figure 11:
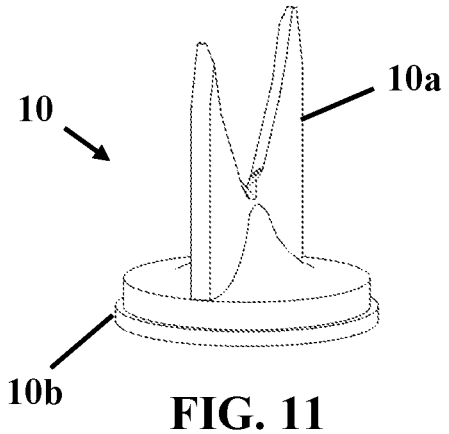
FIG. 11 is a perspective view of the accelerator of the feed box.
Figure 12:
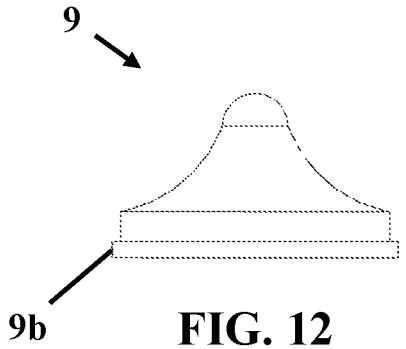
FIG. 12 is a side view of the diverter of the feed box.
Figure 13:
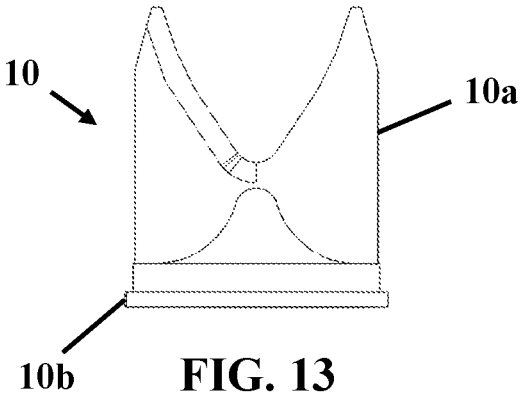
FIG. 13 is a side view of the accelerator of the feed box.
Figure 14:
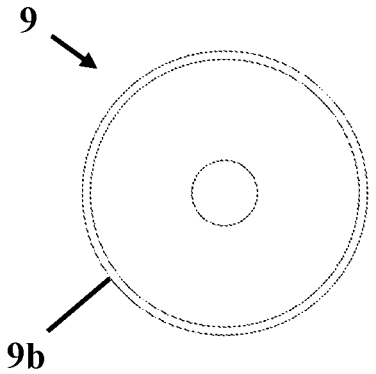
FIG. 14 is a top view of the diverter of the feed box.
Figure 15:
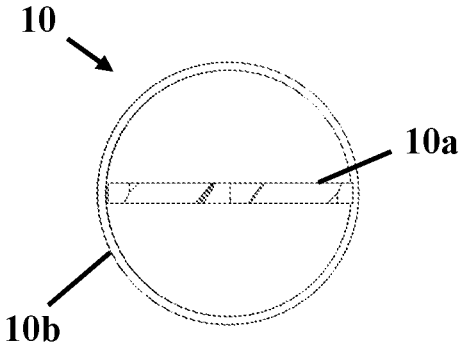
FIG. 15 is a top view of the accelerator of the feed box.

As shown in FIGS. 1-7, the feed box 1 has a housing 4, which is a hollow box-shaped structure with an opening on the top 4*a*, below the inlet 2. The housing 4 is also open on both opposing ends 4*b*, permitting fluid communication between the inlet 2, the opposing ends 4*b*, and the hollow interior of the housing 4. A liner 5 is secured in place within the housing 4 by way of a plurality of keys 6. The liner 5 is shaped to slide into the hollow interior of the housing 4 through the open ends 4*b* and fit closely therein. As shown in FIG. 8, the liner 5 has an opening 7 on the top 5*a*, which is positioned below the inlet 2 and has a channel 8 therethrough between the opposing ends 5*b*, to permit the feed to flow from the inlet 2 into the channel 8 and out the outlets 3. A diverter 9, as shown in FIGS. 10, 12, and 14, is positioned within the channel 8, below the inlet 2 to improve the flow of feed from the inlet 2 to the outlets 3. Alternatively, an accelerator 10 having vanes 10*a*, as shown in FIGS. 11, 13, and 15, may be used instead of a diverter 9 to increase the initial acceleration of the feed in the channel 8 as it flows through the feed box 1 and out the outlets 3.

Figure 1:
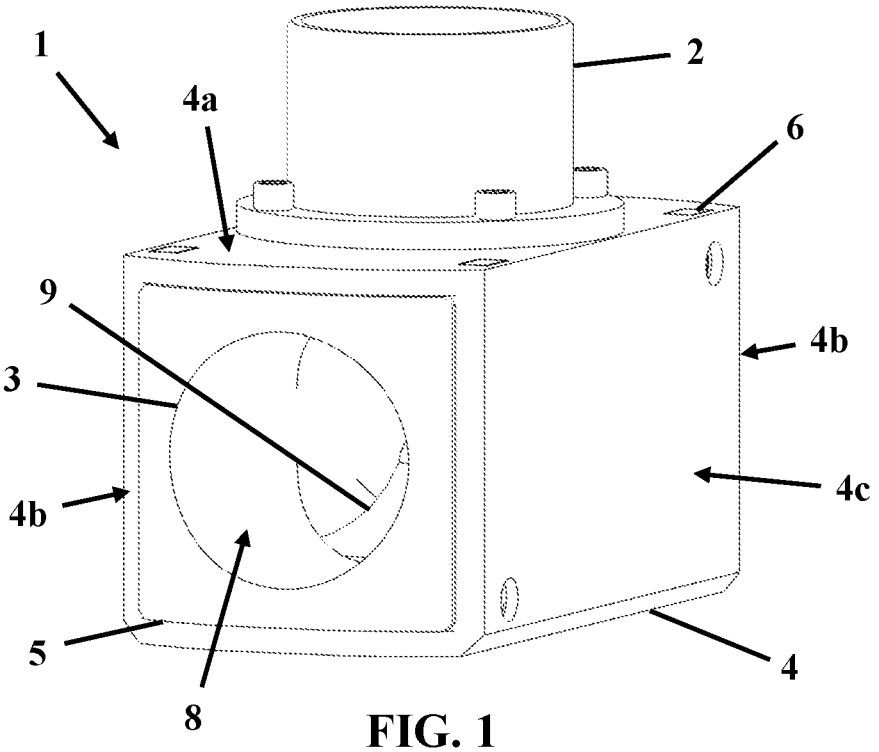
FIG. 1 is a perspective view of a feed box, according to the present invention, for use in a decanter centrifuge.
Figure 2:
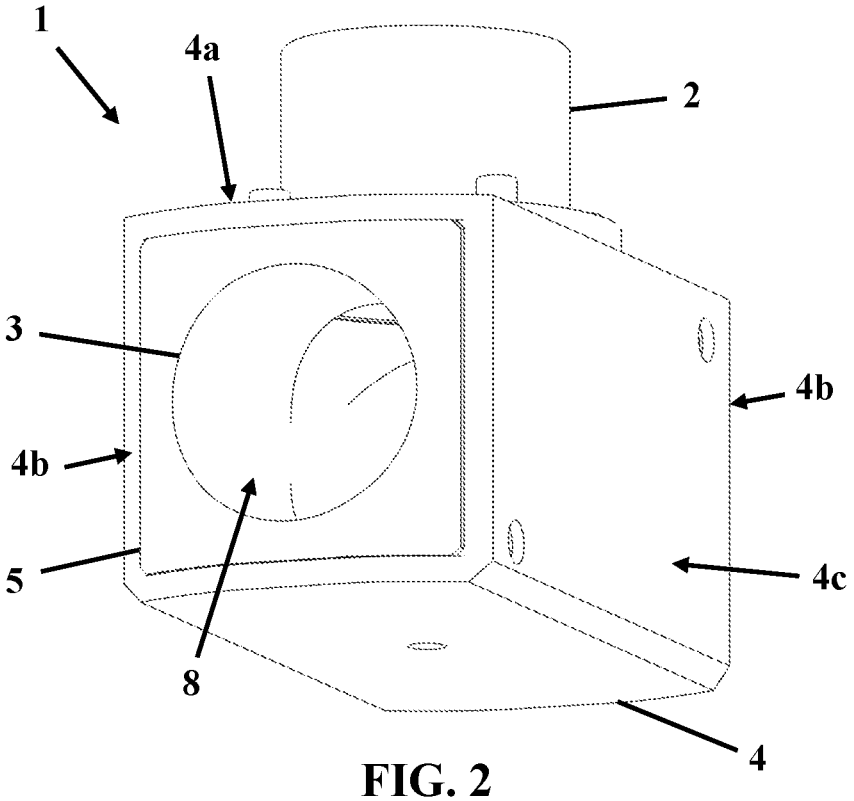
FIG. 2 is another perspective view of the feed box.
Figure 3:
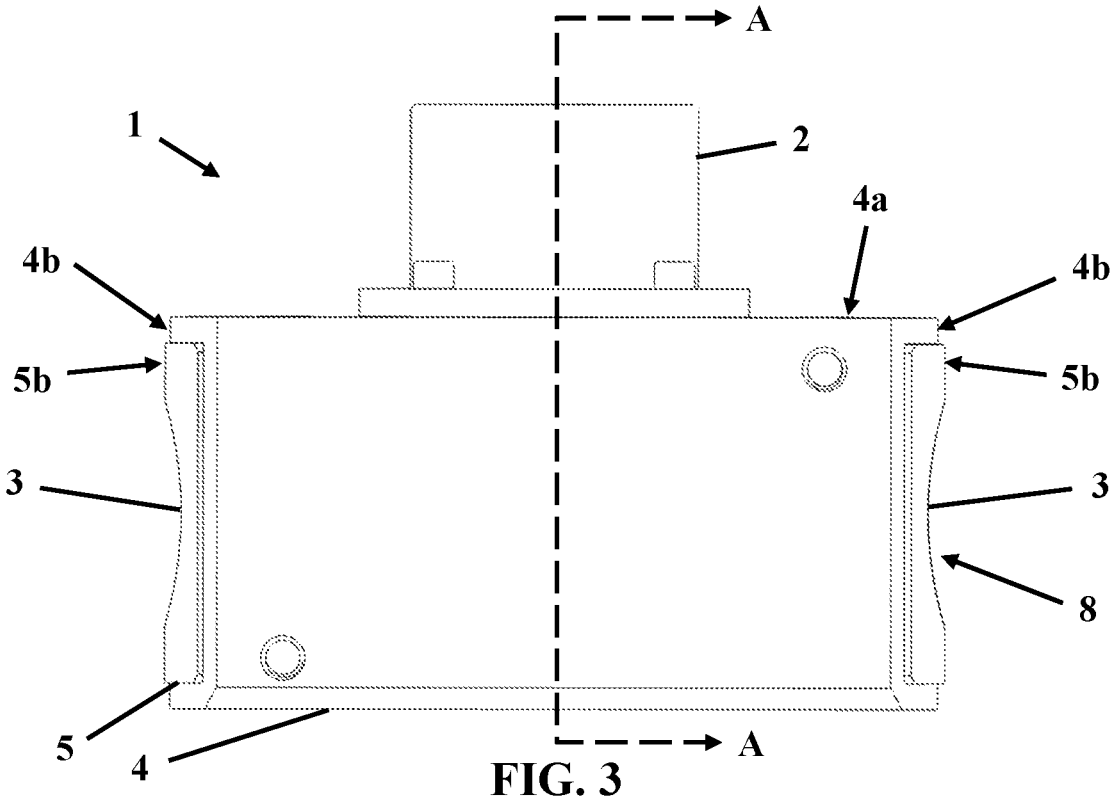
FIG. 3 is a side view of the feed box.
Figure 4:
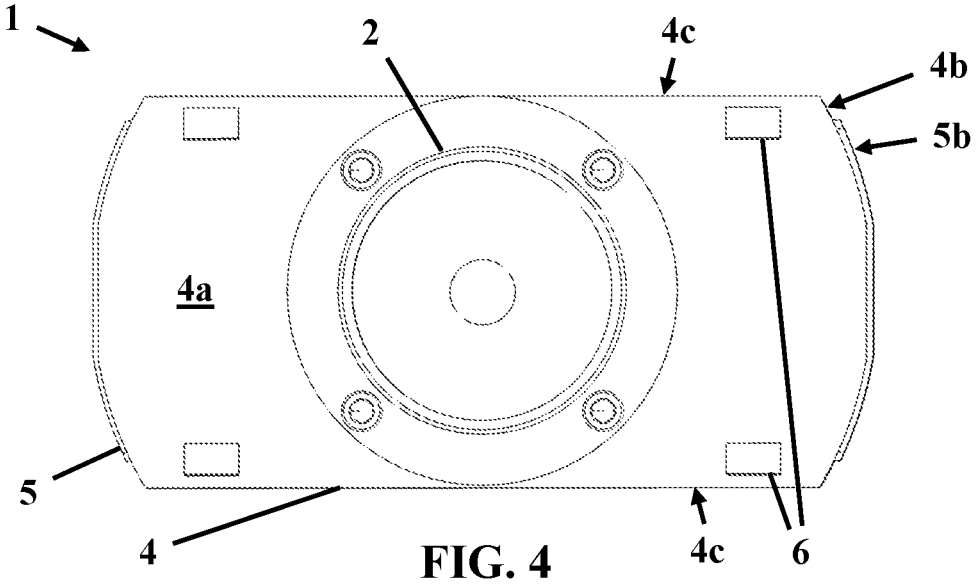
FIG. 4 is a top view of the feed box.
Figure 5:
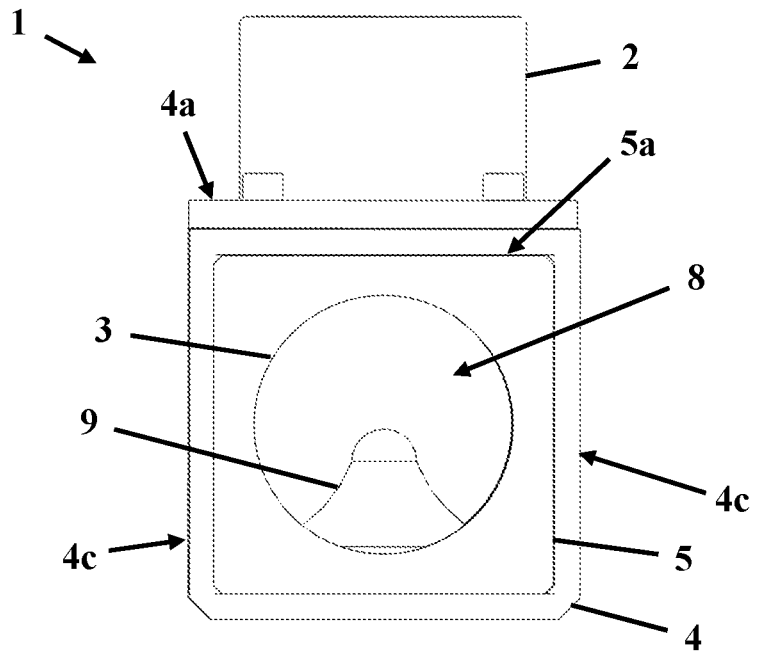
FIG. 5 is an end view of the feed box.
Figure 6:
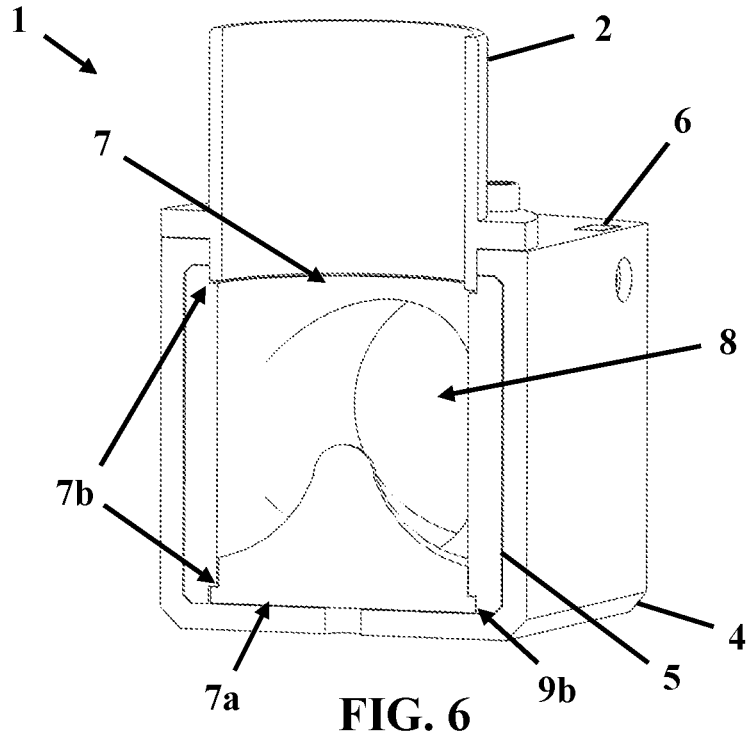
FIG. 6 is a sectional view of the feed box, along lines A-A in FIG. 3.
Figure 7:
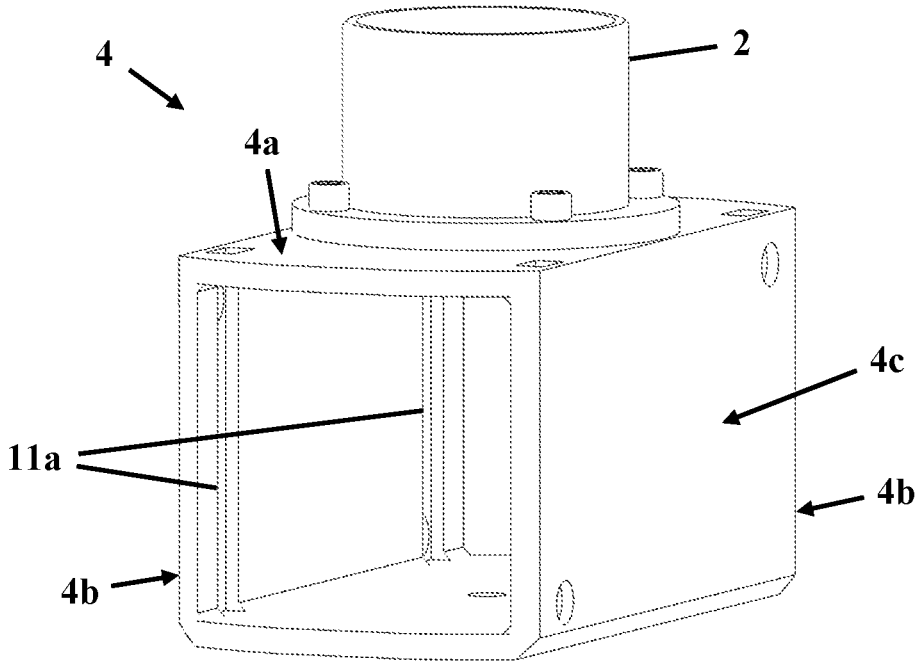
FIG. 7 is a perspective view of the housing of the feed box, with the liner removed.

Preferably, the liner 5 has a second opening 7*a*, located opposite the opening 7 on the top 5*a* of the liner 5, in which a diverter 9 or an accelerator 10 is seated, as shown in FIG. 6. The openings 7 and 7*a* narrow to form a shoulder 7*b* which fits with a complementary raised lip 9*b* and 10*b* on the diverter 9 or accelerator 10 to retain them in place within either opening 7 or 7*a*. This permits the liner 5 to be removed, flipped 180° so that the second opening 7*a* is positioned facing the inlet 2 and the diverter 9 or accelerator 10 seated in the opening 7. The liner 5 may then be re-inserted into the housing 4 and again secured in place for further use. This may extend the service life of the liner 5, because the wear caused by the flow of the abrasive feed is not evenly distributed within the liner 5.

Optionally, the diverter 9, or the accelerator 10 may be formed integrally with the liner 5, in which case the liner 5 and the diverter 9 or accelerator 10 are formed as a single-piece, or monolithic, structure. Preferably, the liner 5 is a single piece structure and the diverter 9 or accelerator 10 is a separate structure, so as to permit the liner 5 to be flipped, as described above.

Figure 9:
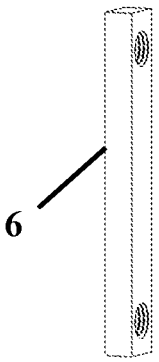
FIG. 9 is a perspective view of a key of the feed box.

As shown in FIG. 9, the keys 6 are elongated rods inserted through key holes on the top 4*a* of the housing 4. The keys 6 have threaded holes adjacent their ends to permit them to be locked in the housing 4 by way of cap screws through the sides 4*c* of the housing. Preferably, the cap screws (not shown) also serve to lock the feed box 1 in place within the scroll of the decanter centrifuge. The keys 6 slide into grooves 11*a* on the inside of the housing 4, which line up with grooves 11*b* on the outside of the liner 5, thereby limiting relative movement between the liner 5 and the housing 4. With the keys 6 inserted into the grooves 11*a* and 11*b* and the cap screws in place, the liner 5 is locked within the housing 4. Preferably, the housing 4 is made of stainless steel and the liner 5 is made of solid tungsten carbide.

The feed box 1 is illustrated as having a generally square cross-sectional shape, but other shapes may be used. For example, the feed box 1 may have a rectangular cross-sectional shape. Preferably, a symmetrical cross-sectional shape is used, to permit the liner 5 to be flipped and re-used, as described above. However, any cross-sectional shape may be used, as desired for the particular application, so long as the cross-sectional shape of the interior of the housing 4 remains consistent along the length of the feed box 1.

The present invention has been described and illustrated with reference to an exemplary embodiment, however, it will be understood by those skilled in the art that various changes may be made and equivalents may be substituted for elements thereof without departing from the scope of the invention as set out in the following claims. Therefore, it is intended that the invention not be limited to the particular embodiments disclosed herein.

What is claimed is:

1. A feed box for a decanter centrifuge, comprising:

a housing with a hollow interior, the housing having a top with an inlet therethrough, a bottom, sides, and opposing open ends, wherein the inlet and the open ends are in fluid communication with the hollow interior;

a liner shaped complementary to the hollow interior of the housing, having a top, a bottom, sides, opposing ends, an opening through the top of the liner below the inlet, and a channel through the liner between the opposing ends in fluid communication with the inlet, wherein the liner is a single-piece structure.

2. The feed box of claim 1, wherein a diverter is positioned below the inlet within the channel.

3. The feed box of claim 1, wherein an accelerator is positioned below the inlet within the channel.

4. The feed box of claim 1, wherein the liner is secured in the hollow interior of the housing by one or more keys, which engage the liner and the housing to limit relative movement therebetween.

5. The feed box of claim 4, wherein the one or more keys slide into one or more first grooves on the inside of the housing which line up with one or more second grooves on the outside of the liner.

6. The feed box of claim 1, wherein the cross-sectional shape of the inside of the housing remains unchanged in its dimensions along the length of the feed box.

7. The feed box of claim 6, wherein the liner has a symmetrical cross-sectional shape.

8. The feed box of claim 7, wherein the liner has a second opening through the bottom of the liner opposite the inlet.

9. The feed box of claim 8, wherein the opening and the second opening narrow to form a shoulder, and wherein a diverter with a raised lip shaped complementary to the shoulder fits within either the opening or the second opening and is positioned within the channel.

10. The feed box of claim 8, wherein the opening and the second opening narrow to form a shoulder, and wherein an accelerator with a raised lip shaped complementary to the shoulder fits within either the opening or the second opening and is positioned within the channel.

* * * * *